US005177322A

United States Patent [19]

Nishimura et al.

[11] Patent Number: 5,177,322

[45] Date of Patent: Jan. 5, 1993

[54] DEVELOPING DEVICE HAVING TONER CARRYING BODY AND METHOD OF FABRICATING TONER CARRYING BODY

[75] Inventors: Masayuki Nishimura, Iwatsuki; Hiromu Ono, Suzuka, both of Japan

[73] Assignee: Fuji Xerox Co., Ltd., Tokyo, Japan

[21] Appl. No.: 732,761

[22] Filed: Jul. 19, 1991

[30] Foreign Application Priority Data

Jul. 20, 1990 [JP] Japan ..... 2-192164

[51] Int. Cl.[5] ..... G03G 15/08

[52] U.S. Cl. ..... 118/653; 29/895.32; 355/259

[58] Field of Search ..... 355/245, 259, 251; 118/653, 657; 29/895, 895.32; 430/120, 122

[56] References Cited

U.S. PATENT DOCUMENTS

| | | | |
|---|---|---|---|
| 3,754,963 | 8/1973 | Chang | 430/120 |
| 4,522,907 | 6/1985 | Mitsuhashi et al. | 430/102 |
| 4,564,285 | 1/1986 | Yasuda et al. | 355/259 X |
| 4,989,044 | 1/1991 | Nishimura et al. | 355/251 |
| 4,990,963 | 2/1991 | Yamamoto et al. | 355/259 |

FOREIGN PATENT DOCUMENTS

| | | | |
|---|---|---|---|
| 2-89075 | 3/1990 | Japan | 355/245 |

*Primary Examiner*—Joan H. Pendegrass
*Attorney, Agent, or Firm*—Finnegan, Henderson, Farabow, Garrett and Dunner

[57] ABSTRACT

The invention is applied to a developing device having a cylindrical toner carrying body. The cylindrical toner carrying body includes a cylindrical electrically conductive inner layer and a cylindrical semiconductor outer layer. The surface potential at the semiconductive outer layer is controlled by power supplies connected to the electrically conductive inner layer, so that particles of a single-component toner charged by friction can adhere to the semiconductive outer layer surface. In such a developing device having the thus constructed toner carrying body, the electrically conductive inner layer is formed of a cylindrical sleeve made of an electrically conductive metallic material, and the semiconductive outer layer not only is formed of a semiconductive resin layer coated on the outer peripheral surface of the cylindrical sleeve but also has uniform irregularities on its surface.

4 Claims, 6 Drawing Sheets

DEVELOPING DEVICE HAVING TONER CARRYING BODY AND METHOD OF FABRICATING TONER CARRYING BODY

BACKGROUND OF THE INVENTION

The invention relates to a developing device having a toner carrying body which causes toner particles to adhere to a surface on which a latent electrostatic image has been formed (e.g., a surface on a photosensitive drum of an electronic copying machine) and a method of fabricating such toner carrying body.

A developing device using a toner carrying body of this type is disclosed in Japanese Patent Unexamined Publication No. 223769/1986 and the like. The developing device will be outlined below with reference to FIGS. 4 to 7A–7C.

A fix/support shaft 01 shown in FIG. 4 is fixed and supported by a not shown support member, and fixes and supports a cylindrical magnet roll MR0. As shown in FIG. 5, the magnet roll MR0 has a plurality of magnetic poles arranged inwardly around its outer peripheral surface, the poles extending along its length. At both end portions of the fix/support shaft 01 are a pair of rotating support members 02, 02 rotatably supported, and both ends of a cylindrical toner carrying body 03 are fixed and supported by these rotating support members 02, 02. The rotating force of a not shown drive motor is transmitted to the toner carrying body 03 through gears, the support members 02, and the like. The toner carrying body 03 also has an electrically conductive inner layer **03*a* and a semiconductive outer layer 03*b*. The layer 03*a* confronts the magnet roll MR0 while keeping a predetermined distance from the outer peripheral surface of the magnet roll MR0, and the layer 03*b* is disposed on the outer peripheral surface of the layer 03*a* in a laminated form. The reason why the outer layer 03*b* is made semiconductive is that if the outer layer 03*b* were electrically conductive, discharge would be caused between the toner carrying body 03** and the surface of a photosensitive body when a high voltage is applied therebetween during a development process, and this discharge would act to remove electric charges generated at the photosensitive body surface, producing defects such as white points in a solid black portion of an image or black points in a nonimage portion.

FIG. 5 is a diagram schematically illustrating a developing device using the toner carrying body 03. A hopper 05 which contains an electrically insulating single-component magnetic toner 04 has a toner carrying body insertion inlet **05*a* formed, and an upper edge of the toner carrying body insertion inlet 05*a* coincides with an edge of a magnetic blade 05*b*. This magnetic blade 05*b* serves to reduce excessive single-component magnetic toner particles so that the thickness of a toner layer formed on the surface of the toner carrying body 03** can be maintained constant.

The toner carrying body 03 is installed in such a manner that a part of it is received by the hopper 05 from the toner carrying body insertion inlet **05*a* and that the rest is exposed from the hopper 05. The photosensitive body surface 06*a* of a photosensitive drum 06 is arranged so as to confront the portion of the semiconductive outer layer 03*b* of the toner carrying body 03 which is exposed from the hopper 05. An electrically conductive layer 06*b* in the interior of the photosensitive body surface 06*a* is grounded, while the electrically conductive inner layer 03*a* of the toner carrying body 03 is grounded through an ac power supply 07 and a dc power supply 08** for biasing, both connected in series.

As shown in FIGS. 6A and 7A, a bias voltage of the dc power supply 08 is set to such a value that a bias potential $V_A$ at the semiconductive outer layer **03*b* that is determined by such bias voltage becomes a value that is in between a charging potential $V_B$ at an image portion (a black portion) (hereinafter referred to as "image potential") and a charging potential $V_L$ at a nonimage portion (a white portion) (hereinafter referred to as "background potential") on the photosensitive body surface 06*a*. The ac power supply 07 is set to such a value that a maximum potential $V_{MAX}$ at the semiconductive outer layer 03*b* is higher than the image potential $V_H$ at the photosensitive body surface 06*a* and that a minimum potential $V_{MIN}$ is lower than the background potential $V_L$. Therefore, as shown in FIG. 6A, the image potential VH at the photosensitive body surface 06*a* is higher than the surface potential at the semiconductive outer layer 03*b* of the toner carrying body 03 during time intervals $t_1, t_3, ..., T_{2n-1} (n=1, 2, ...)$, and the direction of the electric field between the surface 06*a* and the layer 03*b* runs from the semiconductive outer layer 03*b* to the photosensitive body surface 06*a* as indicated by arrows Ef' in FIG. 6A. Also, the image potential VH at the photosensitive body surface 06*a* is lower than the surface potential at the semiconductive outer layer 03*b* during time intervals $t_2, t_4, ..., t_{2n} (n=1, 2, ...)$, and the direction of an electric field between the surface 06*a* and the layer 03*b* runs from the photosensitive body surface 06*a* to the semiconductive outer layer 03*b* as indicated by arrows Er' in FIG. 6A. On the other hand, as shown in FIG. 7A, the background potential VL at the photosensitive body surface 06*a* is higher than the surface potential at the semiconductive outer layer 03*b* of the toner carrying body 03 during times $t_1, t_3, ..., t_{2n-1'} (n=1, 2, ...)$, and the direction of the electric field between the surface 06*a* and the layer 03*b* at these time intervals is as indicated by arrows Ef' in FIG. 7A**, while the background potential $V_L$ is lower during time intervals $t_{2'}, t_{4'}, ..., t_{2n'} (n=1, 2, ...)$, and the direction of the electric field is as indicated (a) by arrows Er'.

As described before, the relative magnitudes of the image potential $V_H$ or background potential $V_L$ at the photosensitive body surface **06*a* and of the surface potential at the semiconductive outer layer 03*b* of the toner carrying body 03 get inverted in correspondence with the cycle of the ac power supply 07, and this generates an electric field whose direction is changed alternately between the photosensitive body surface 06*a* and the semiconductive outer layer 03*b*. Assuming that an electric field generated when the potential at the photosensitive body surface 06*a* is higher than that of the semiconductive outer layer 03*b* (hereinafter referred to as "toner adhering electric field") is designated by Ef and that an electric field generated when the potential at the photosensitive body surface 06*a* is lower than that of the semiconductive outer layer 03*b* (hereinafter referred as "toner detaching electric field") is designated by Er, each electric field Ef or Er becomes more intensive with a shorter distance between the photosensitive body surface 06*a* and the semiconductive outer layer 03*b* as shown in FIGS. 6B, 6C, 7B, 7C. And the intensity of each electric field Ef or Er in regions A2, A2' gets larger than that in regions A1, A1', and A3, A3'**.

If the toner carrying body 03 and the photosensitive drum 06 are rotated in directions of arrows X and Y, respectively, when this type of developing device is operated, then the single-component magnetic toner 04 is, e.g., negatively charged by friction, adheres to the semiconductive outer layer 03*b* of the toner carrying body 03 to a predetermined thickness adjusted by the magnetic blade 02*b*, and approaches the photosensitive body surface 06*a*.

At this instance, the single-component magnetic toner 04 on the semiconductive outer layer 03*b* behaves differently between a case where the potential at the photosensitive body surface 06*a* is equal to the image potential $V_H$ (as shown in FIGS. 6A to 6C) and a case where it is equal to the background potential $V_L$ (as shown in FIGS. 7A to 7C). The case where the surface potential at the photosensitive body surface 06*a* is equal to the image potential $V_H$ will be described first.

In FIGS. 6A to 6C, when the semiconductive outer layer 03*b* approaches the photosensitive body surface 06*a* to enter the region A1, the toner adhering electric field Ef between both surfaces 03*b* and 06*a* becomes larger than a movement start threshold electric field Efth (see FIG. 6C), the electric field Efth being an electric field which causes the single-component magnetic toner 04 to move from the semiconductive outer layer 03*b* to the photosensitive body surface 06*a* (by flying in air), while the toner detaching electric field Er remains at its movement start threshold electric field Erth or less. At this instance, the single-component magnetic toner 04 which has adhered to the semiconductive outer layer 03*b* moves to the photosensitive body surface 06*a* to adhere thereto. A term "adhering movement" which will hereinafter be used is intended to mean movement of the toner 04 from the semiconductive outer layer 03*b* to the photosensitive body surface 06*a*, and a term "detaching movement", movement of the toner 04 opposite to the adhering movement. The former will be indicated by an arrow F (see FIGS. 6C, 7C) and the latter by an arrow R (see FIGS. 6C, 7C).

As the semiconductive outer layer 03*b* approaches the photosensitive body surface 06*a* further to enter the region A2, the toner detaching electric field Er between both surfaces 03*b* and 06*a* also becomes larger than its movement start threshold electric field Erth that causes the single-component magnetic toner 04 to start moving from the photosensitive body surface 06*a* to the semiconductive outer layer 03*b*. As a result, the electric fields Ef, Er generated by the ac power supply 07, with their direction being alternated, cause the single-component magnetic toner 04 to shuttle between the semiconductive outer layer 03*b* and the photosensitive body surface 06*a* with its adhering movement F from the layer 03*b* to the surface 06*a* and its detaching movement R opposite to the adhering movement F. At this instance, since the toner adhering electric field Ef is larger than the toner detaching electric field Er, the toner adhering movement F has greater power than the toner detaching movement R.

Then, when the semiconductive outer layer 03*b* and the photosensitive body surface 06*a* rotate further to enter the region A3, the toner adhering electric field Ef between both surfaces 03*b* and 06*a* remains at the movement start threshold electric field Efth or more, while the toner detaching electric field Er becomes the movement start threshold electric field Efth or less. As a result, the single-component magnetic toner 04 moves only from the semiconductive outer layer 03*b* of the toner carrying body 03 to the photosensitive body surface 06*a*. After both surfaces 03*b* and 06*a* have passed the region A3, the movement of the single-component magnetic toner 04 is stopped. Accordingly, the single-component magnetic toner 04 adheres on the photosensitive body surface 06a that is held at the image potential $V_H$.

The case where the surface potential at the photosensitive body surface 06*a* is equal to the background potential will be described next.

In FIGS. 7A to 7C, when the semiconductive outer layer 03*b* approaches the photosensitive body surface 06*a* to enter the region A1, the toner detaching electric field Er between both surfaces 03*b* and 06*a* becomes larger than the movement start threshold electric field Erth, while the toner adhering electric field Ef remains at the adhering movement start threshold electric field Efth or less. At this instance, if some single-component magnetic toner 04 were present on the photosensitive body surface 06*a*, such single-component magnetic toner 04 should move toward the semiconductive outer layer 03*b*. However, with no such single-component magnetic toner 04 that should make a detaching movement R present on the photosensitive body surface 06*a*, there occurs no movement of the single-component magnetic toner 04.

As the semiconductive outer layer 03*b* approaches the photosensitive body surface 06*a* further to enter the region A2, both the toner detaching electric field Er and the toner adhering electric field Ef between both surfaces 03*b* and 06*a* become larger than the movement start threshold electric fields Erth and Efth, respectively. As a result, the electric fields Ef, Er generated by the ac power supply 07, with their direction being alternated, causes the single-component magnetic toner 04 to shuttle between the semiconductive outer layer 03*b* and the photosensitive body surface 06*a* with its adhering movement F from the layer 03*b* to the surface 06a and its detaching movement R opposite to the adhering movement F. At this instance, since the toner detaching electric field Er is larger than the toner adhering electric field Ef, the toner detaching movement R has greater power than the toner adhering movement F.

Then, when the semiconductive outer layer 03*b* and the photosensitive body surface 06*a* rotate further to enter the region A3, the toner detaching electric field Er between both surfaces 03*b* and 06*a* remains at the movement start threshold electric field Erth or more, while the toner adhering electric field Ef becomes the movement start threshold electric field Efth or less. As a result, the single-component magnetic toner 04 moves only from the photosensitive body surface 06*a* to the semiconductive outer layer 03*b*. After both surfaces 03*b* and 06*a* have passed the region A3, the movement of the single-component magnetic toner 04 is stopped. Accordingly, the single-component magnetic toner 04 no longer adheres on the photosensitive body surface 06*a* that is held at the background potential $V_L$.

The development method described with reference to FIGS. 6A to 6C and 7A to 7C comprises the steps of: causing a single-component magnetic toner to adhere to the toner carrying body 03 surface by the magnetic force of the magnet roll MR0; forming the adhering toner into a layer of a predetermined thickness by the magnetic blade 05*b*; moving the thus processed toner to the photosensitive body surface 06*a* before development. A development method similarly involving movement of a toner may also be applied to a single-component nonmagnetic toner.

To cause the single-component nonmagnetic toner to adhere to the toner carrying body surface forces such as electrostatic forces (mirror image forces), adhering forces, and van der waals forces are used since no magnetic force can be utilized. Since the adhesiveness for causing the toner to adhere to the toner carrying body surface possessed by these forces is small compared with the magnetic force, various design considerations are made to form an even toner layer on the toner carrying body surface using these forces whose adhesiveness is small. For example, in a conventional developing device using a single-component nonmagnetic toner as shown in FIG. 8, a toner supply member 011 for causing toner particles to adhere to the toner carrying body 010 surface is employed, and special considerations are given to the shape and position of a thickness regulating member 012. In FIG. 8, the thickness regulating member 012 includes a stainless strip 013 and a silicone rubber 014 which is adhesively fixed at a free end of the strip 013. As the toner carrying body 010 surface rotates, the single-component nonmagnetic toner is fed to a nipped portion between the toner carrying body 010 surface and the thickness regulating member 012 that is nipped (in pressure contact) with the toner carrying body 010 surface. The single-component nonmagnetic toner that has reached the nipped portion is then charged by friction, adsorbed by the electrostatic force or the like onto the toner carrying body 010 surface and levelled by the thickness regulating member 012 that is nipped with the toner carrying body 010 surface to be formed into an even layer.

By the way, developing devices generally produce nonuniform densities and the like in developed images once nonuniformity is caused in the distribution of toner particles on the toner carrying body surface. Therefore, the toner carrying body used in the developing devices must be arranged so that the toner can adhere to its surface evenly.

Further,, since inconsistency in the distance between the toner carrying body surface and the photosensitive body surface causes nonuniformity in developed images, the distance must be maintained at a constant value.

From the above requirements, a toner carrying body which is to be applied to a developing device using a single-component nonmagnetic toner must possess the following properties and characteristics.

(a) The resistivity by volume of a material that is used to form the semiconductive outer layer is less erratic.

(b) The outer diameter of the semiconductive outer layer is less erratic and its surface is macrographically smooth.

(c) The amount of flexion of the toner carrying body shaft is small.

Further, a toner carrying body to be applied to a developing device using a single-component nonmagnetic toner whose adhesiveness to the toner carrying body is extremely small requires the following additional characteristic in order to increase its adhesiveness.

(d) Uniform irregularities micrographically having a surface roughness Rz of from 1.0 μm to 10 μm is formed on the When the surface roughness Rz is less than 2.5 μm, defects such as white points are accidentally produced in a solid black portion of an image due to lack of supplying quantity of the toner. In addition, when any foreign matter (undesirable dust and the like) is accidentally introduced into the gap between the toner carrying body and the magnetic blade, it is difficult to remove it.

When the surface roughness Rz is more than 4.5 μm, the toner which is adhered to the photosensitive drum is not correctly transferred to the latent image due to lack of electrification of the toner. Further, there is a problem that the poor electrified toner is accidentally transferred to the back ground, that is the portion except for the latent image portion.

Furthermore, a toner carrying body to be applied to a developing device using a single-component magnetic toner may provide additional advantages if it has the following characteristic.

(e) If a magnet roll producing a small magnetic force is used, the distance between the toner carrying body surface and the magnet roll surface is as small as possible to maximize the magnetic force of the toner carrying body surface.

By the way, the method of fabricating the conventional toner carrying body 03 shown in FIGS. 6A to 6C forms a cylindrical semiconductive resin sleeve by means of compression molding, injection molding, or extrusion molding using a material such as phenol resin having an electrically conductive material mixed therewith. And with this cylindrical sleeve, a semiconductive outer layer **03*b*** is formed on the sleeve, and an electrically conductive inner layer, inside the sleeve. The method, being as such, addresses the following problems.

(1) Unsatisfactory dimensional accuracy in the molding requires that the formed body be subjected to post-processing such as grinding of the outer diameter and processing of both ends, thereby increasing the number of processes involved.

(2) The forming of the electrically conductive layer on the inner peripheral surface of the cylindrically formed semiconductive resin sleeve is cumbersome compared with the formation of layers on the exposed outer peripheral surface.

(3) The semiconductive resin sleeve is made of phenol resin having an electrically conductive material mixed therewith and the like, and the rigidity of the resin is not adequately large. Therefore, the semiconductive resin sleeve cannot be made thinner, and if a single-component magnetic toner is used, the distance between the semiconductive resin sleeve surface, i.e., the toner carrying body 03 surface, and the magnet roll MR0 surface may not be reduced. Thus, a magnet roll MR0 whose magnetic force is larger must be used to increase the magnetic force of the toner carrying body 03 surface.

(4) The above problems (1) to (3) contribute to elevating the fabrication cost of the toner carrying body 03 shown in FIG. 4.

Also conventionally known is a toner carrying body which adhesively combines a resin-made semiconductive sleeve with the outer surface of a metal-made electrically conductive sleeve using an electrically conductive adhesive. However, in this type of toner carrying body, failure to uniformly apply the electrically conductive adhesive to a gap between both sleeves may cause irregular recesses to be created on the toner carrying body surface or make surface potentials inconsistent due to defective adhesion. Since both sleeves cannot be made thinner, the distance between the magnet roll surface and the toner carrying body surface should become large when the magnet roll is installed inside the sleeves. This reduces the magnetic force of the toner carrying body surface even if the magnetic force of the magnet roll is large.

Further, Japanese Patent Examined Publication No. 5704/1089 discloses a toner carrying body and a developing device using such toner carrying body. This toner carrying body has a metallic sleeve surface and a resin layer coated with a compound of silane on that surface. However, the art disclosed in this publication does not consider a case of using a single-component nonmagnetic toner with small adhesiveness to the toner carrying body, nor does it consider the profile of the toner carrying body surface. Therefore, the toner carrying body proposed in the above publication has the problem of not being applicable to a developing device using a single-component nonmagnetic toner that is less adhesive.

Still further, Japanese Patent Examined Publication No. 23864/1990 proposes a toner carrying body, which is formed by grinding a dielectric layer coated on a metallic sleeve surface, forming on the ground surface an electrically conductive particle layer coated with a resin through an adhesive, and grounding the thus formed surface so that the electrically conductive particles are exposed. However, the construction and fabrication method of the toner carrying body proposed in this publication is disadvantageously complicated.

SUMMARY OF THE INVENTION

The invention has been made in view of the above circumstances. Accordingly, an object of the invention is to provide not only a developing device having a toner carrying body which possesses the properties and characteristics indicated in (a) to (c) and which is applicable to development also with a single-component nonmagnetic toner, but also a method of fabricating such toner carrying body.

To achieve the above object, a first aspect of the invention is applied to a developing device having a cylindrical toner carrying body. The cylindrical toner carrying body includes a cylindrical electrically conductive inner layer and a cylindrical semiconductive outer layer. The surface potential at the semiconductive outer layer is controlled by power supplies connected to the electrically conductive inner layer, so that particles of a single-component toner charged by friction can adhere to the semiconductive outer layer surface. In such a developing device having the thus constructed toner carrying body, the electrically conductive inner layer is formed of a cylindrical sleeve made of an electrically conductive metallic material, and the semiconductive outer layer not only is formed of a semiconductive resin layer coated on the outer peripheral surface of the cylindrical sleeve but also has uniform irregularities on its surface.

A second aspect of the invention is applied to a method of fabricating a toner carrying body which includes a cylindrical electrically conductive inner layer and a semiconductive outer layer. The inner layer is formed of an electrically conductive metallic material, and the outer layer is formed of a semiconductive resin layer formed on the outer peripheral surface of the cylindrical sleeve. In such a toner carrying body, the surface potential at the semiconductive outer layer is controlled by power supplies connected to the electrically conductive inner layer, so that particles of a single-component toner charged by friction can adhere to the semiconductive outer layer surface.

The method comprises the steps of: applying a coating material to the outer peripheral surface of the cylindrical sleeve which is made of an electrically conductive metallic material and curing the coating material thereafter to form a semiconductive resin layer on the outer peripheral surface of the cylindrical sleeve. The coating material is prepared by dispersing fine particles into such a solvent as being curable at a predetermined condition, and causes the fine particles to form uniform irregularities when cured.

The "fine particles that form uniform irregularities on the surface when the solvent has been cured" include powder and the like of such a compound as silica, alumina, and silicon carbide.

The toner carrying body to be applied to the thus constructed developing device that is the first aspect of the invention includes a cylindrical sleeve made of an electrically conductive nonmagnetic metallic material and a semiconductive resin layer coated on the outer peripheral surface thereof. Since metallic materials generally have a higher rigidity than resins, the cylindrical sleeve formed of an electrically conductive nonmagnetic metallic material can be made thinner than the conventional semiconductive resin sleeves. Since the semiconductive resin layer is formed on the surface of the cylindrical sleeve (i.e., the exposed surface), its processing is comparatively easy. Further, since the semiconductive outer layer has uniform irregularities formed on its surface, toner can adhere easily thereto.

Further, the method of fabricating a toner carrying body, which is the second aspect of the invention, comprises the steps of applying a coating material to the outer peripheral surface of the cylindrically formed sleeve made of an electrically conductive nonmagnetic metallic material, and curing the coating material to form a semiconductive resin layer on the outer peripheral surface of the cylindrical sleeve. The coating material is prepared by dispersing an extender pigment and an electrically conductive material into such a solvent as being curable at a predetermined condition, and the extender pigment and the electrically conductive material form uniform irregularities when the solvent has been cured. Therefore, the semiconductive resin layer can be formed easily on the cylindrical sleeve surface (i.e., the exposed surface). And the thus formed semiconductive resin layer has uniform irregularities formed on its surface by the fine particles. Since the thus formed toner carrying body contains the fine particles not only on the surface but also in the interior of the semiconductive resin layer, the fine particles will be exposed even if the toner carrying body surface is worn, keeping the irregularities present on its surface at all times. The fine particles serve also as a pigment for holding the thickness of the layer after the coating.

BRIEF DESCRIPTION OF THE DRAWINGS

FIGS. 4 to 7A to 7C are diagrams illustrating conventional examples, of which FIG. 4 is a diagram illustrating a conventional toner carrying body;

FIG. 5 is a diagram illustrating a developing device using the conventional toner carrying body shown in FIG. 4;

FIGS. 6A to 6C and FIGS. 7A to 7C are diagrams illustrating an operation of the developing device shown in FIG. 5.

DETAILED DESCRIPTION OF THE PREFERRED EMBODIMENTS

Embodiments of a developing device having a toner carrying body and of a method of fabricating the toner carrying body of the invention will be described with reference to the accompanying drawings.

Figure 1:
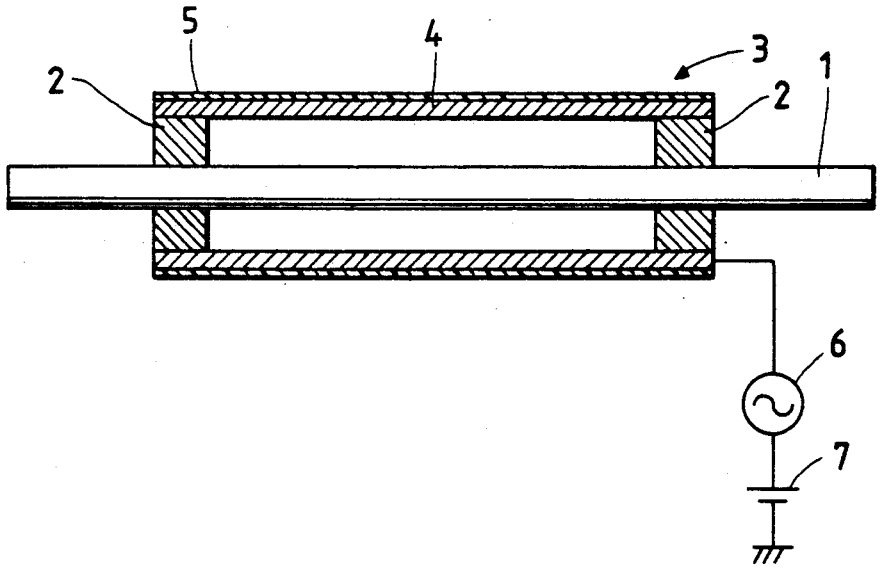
FIG. 1 is a front view showing an exemplary toner carrying body to be applied to a developing device of the invention.

FIG. 1 is a front view of an embodiment of a toner carrying body of the invention. This toner carrying body is adapted for a developing device using a single-component nonmagnetic toner.

In FIG. 1, a support shaft 1 which is rotatably supported by a not shown support member of a developing device has a pair of disk-like support members 2, 2 secured to both end portions thereof, and these disk-like support members 2, 2 fix and support both ends of a toner carrying body 3.

The toner carrying body 3 consists of a cylindrical sleeve (i.e., an electrically conductive inner layer) 4 and a semiconductive resin layer (i.e., a semiconductive outer layer) formed around the outer peripheral surface of the sleeve 4. The sleeve 4 is made of aluminum and has a thickness of 1 mm and an outer diameter of approximately 20.0 mm. Volume resistivity of the semiconductive resin layer 5 is within the range from $10^2$ to $10^{12}$ ($\Omega$·cm). The thickness of the semiconductive resin layer 5 is approximately 110 $\mu$m, and its surface has uniform irregularities whose surface roughness Rz is from 2.5 to 4.5 ($\mu$m).

When the surface roughness Rz is less than 2.5 $\mu$m, defects such as white points are accidentally produced in a solid black portion of an image due to lack of supplying quantity of the toner. In addition, when any foreign matter (undesirable dust and the like) is accidentally introduced into the gap between the toner carrying body and the magnetic blade, it is difficult to remove it.

When the surface roughness Rz is more than 4.5 $\mu$m, the toner which is adhered to the photosensitive drum is not correctly transferred to the latent image due to lack of electrification of the toner. Further, there is a problem that the poor electrified toner is accidentally transferred to the back ground, that is the portion except for the latent image portion.

The cylindrical sleeve (electrically conductive inner layer) 4 may be formed of some other electrically conductive nonmagnetic metallic material such as a nonmagnetic stainless steel.

A method of fabricating the toner carrying body 3, which is an embodiment of the invention, will be described.

The semiconductive resin layer 5 formed on the surface of the cylindrical sleeve 4 is made of the components shown in the following table.

| | |
|---|---|
| Electrically conductive carbon black | 5.0 wt % |
| Fine particles (siliceous extender pigment) | 25.0 wt % |
| Polyester resin | 13.5 wt % |
| Melamine resin | 3.7 wt % |
| Epoxy resin | 4.0 wt % |

-continued

| | |
|---|---|
| Xylol (aromatic hydrocarbon containing solvent) | 22.0 wt % |
| MIBK (ketone containing solvent) | 20.3 wt % |
| Butanol (alcoholic solvent) | 3.2 wt % |
| Butyl Cellosolve | 3.2 wt % |
| Additive (oil for dispersing the pigment) | 0.1 wt % |

As is apparent from the above table, this embodiment uses a siliceous extender pigment as the fine particles. The silicious pigment used in this embodiment is an amorphous silica with a Moh's hardness of 6.5 which is marketed by coating manufacturers as the "10 $\mu$m silica". This 10 $\mu$m silica has variations in grain size and its distribution in terms of percentage by weight is: 98% for particles of less than 10 $\mu$m in maximum diameter; and 2% for particles of 10 $\mu$m or more in maximum diameter. If the surface roughness of the toner carrying body is increased so that Rz=3 ($\mu$m) or more, then it is effective to use a crystal silica with a Moh's hardness of 7 or more obtained by crystallizing the amorphous silica to prevent its wear against the toner. The material of the siliceous extender pigment may include an alumina silica, a fused silica, and quarts glass. Having a Moh's hardness of 7 or more, these types of silica exhibit excellent properties of maintaining the surface roughness and wear resistance.

The above components are mixed by a mixer or the like, and subjected to a dispersing mill process twice during the mixing. As a result, the maximum diameter of the siliceous extender pigment has become 2.5 ($\mu$m). The coating material, which is a material for forming the semiconductive resin layer 5 is prepared in this way.

The coating material has appropriate viscosity and film forming property (a viscosity for making the coating solution less sagging and a property for forming a film of 10 $\mu$m or more thick). The viscosity and film forming property of the coating material can be adjusted by varying the ratio of mixture of solvents containing ether, hydrocarbon, alcohol, and the like.

Then, the coating material is sprayed onto the surface of the aluminum-made cylindrical sleeve 4 using an air spray while rotating the sleeve 4 at a speed of 80 rpm. The sleeve 4 is preheated at from about room temperature to 100° C. After drying at from about room temperature to 130° C. for several tens of seconds, the sprayed surface is baked and cured at from 150° to 250° C. As a result, the semiconductive resin layer 5 of about 60 $\mu$m in thickness can be prepared on the surface of the cylindrical sleeve 4. If such coating process is performed twice, the semiconductive resin layer 5 with a thickness of 110 $\mu$m (although the mathematically obtainable thickness is 120 $\mu$m (60 $\mu$m$\times$2)) can be produced. The surface roughness Rz of the thus prepared toner carrying body 3 is from 2.5 to 4.5 $\mu$m, which is a value suitable for causing toner particles to adhere evenly and stably.

According to the above-described toner carrying body fabrication method of the invention, a semiconductive resin layer 5 having a substantially even thickness can be formed. With its high dimensional accuracy, no further process is required on the layer 5. Having recorded a value of 10 $\mu$m/(200 g/cm) or more in a flexibility test, the 1 mm-thick aluminum-made cylindrical sleeve 4 was found to be acceptable in flexibility. This cylindrical sleeve 4 is about 0.7 mm thinner than the conventional phenol resin-made sleeve 4, and its being thinner allows the magnetic force of the surface of the toner carrying body 3 to be increased to 50 to 200 gauss.

Figure 2B:
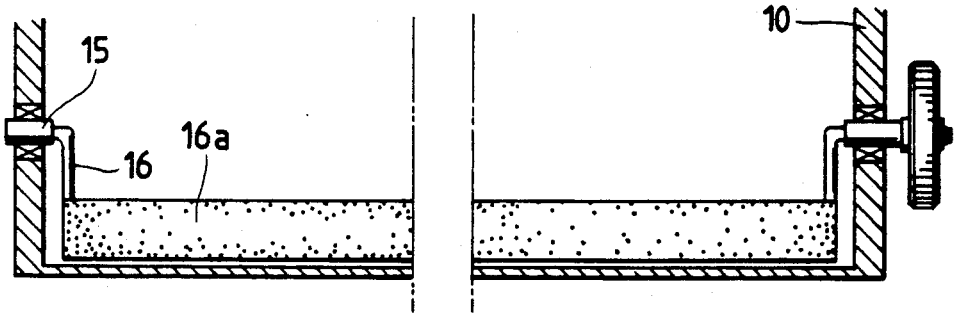
FIGS. 2A to 2C are diagrams illustrating a developing device having the exemplary toner carrying body assembled thereto.

A developing device having the above toner carrying body 3 assembled thereto will now be described with reference to FIGS. 2A to 2C.

Figure 2C:
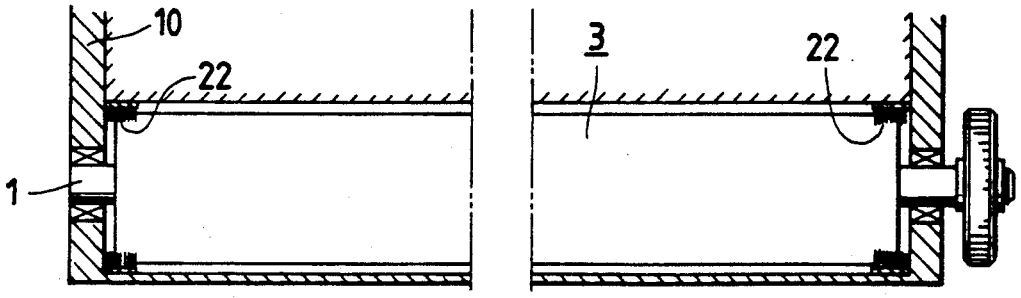
Figure 2A:
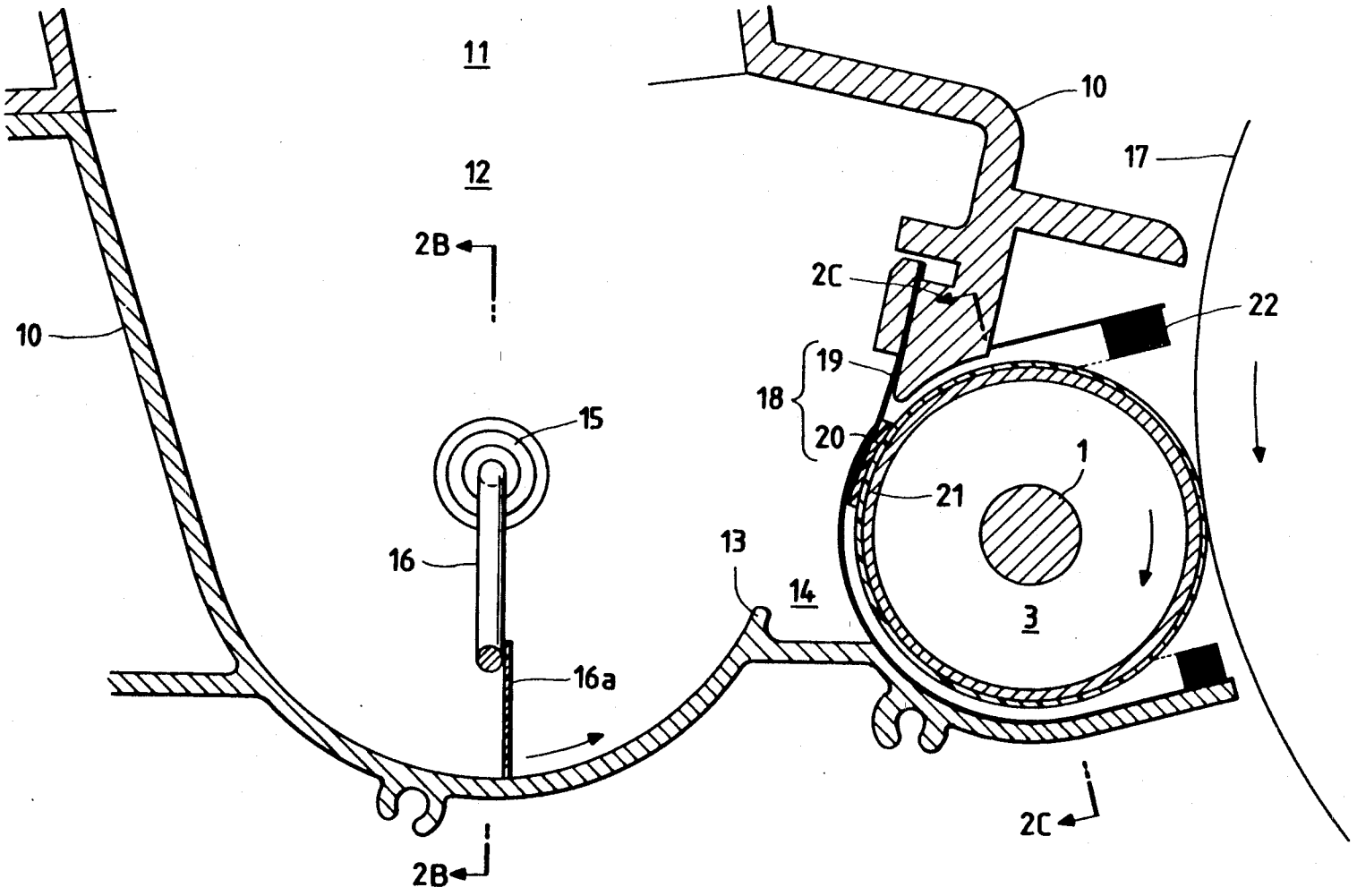

In FIG. 2A, a developing device U has a housing 10, and in the housing 10 are a toner storage chamber 11 for storing a single-component nonmagnetic toner, a stirring chamber 12 disposed below the toner storage chamber 11, a toner carrying body accommodating chamber 14 partitioning itself from the stirring chamber 12 with a small (low) dam 14, and the like. The stirring chamber 12 accommodates a stirring stick 16 that is formed integrally with a rotating shaft 15, and a soft sheet-like MAIRA seal 16*a* that is connected to the stirring stick 16. With the stirring stick 16 and the MAIRA seal 16*a* rotating in a direction indicated by an arrow in FIG. 2A together with the rotating shaft 15, the single-component nonmagnetic toner is stirred so that it will be supplied to the toner carrying body 3 surface without being lumped. The single-component nonmagnetic toner is fed to the toner carrying body accommodating chamber 14 from the stirring chamber 12 while getting across the small dam 13.

The toner carrying body accommodating chamber 14 accommodates the toner carrying body 3 fabricated by the method of the invention. This toner carrying body 3 keeps a distance of about 0.3 to 0.4 mm from the surface of a photosensitive body at an opening of the toner carrying body accommodating chamber 14. The toner carrying body accommodating chamber 14 is also provided with a thickness regulating member 18.

Figure 3A:
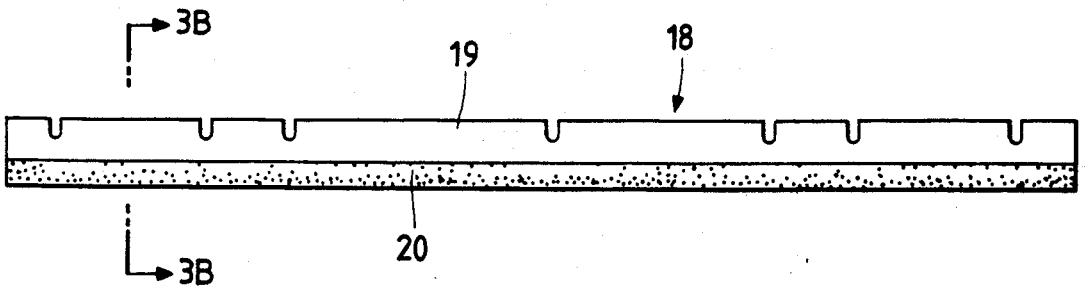
FIGS. 3A and 3B are diagrams illustrating a layer thickness regulating member of the developing device.
Figure 3B:
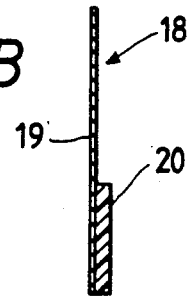
Figure 4:
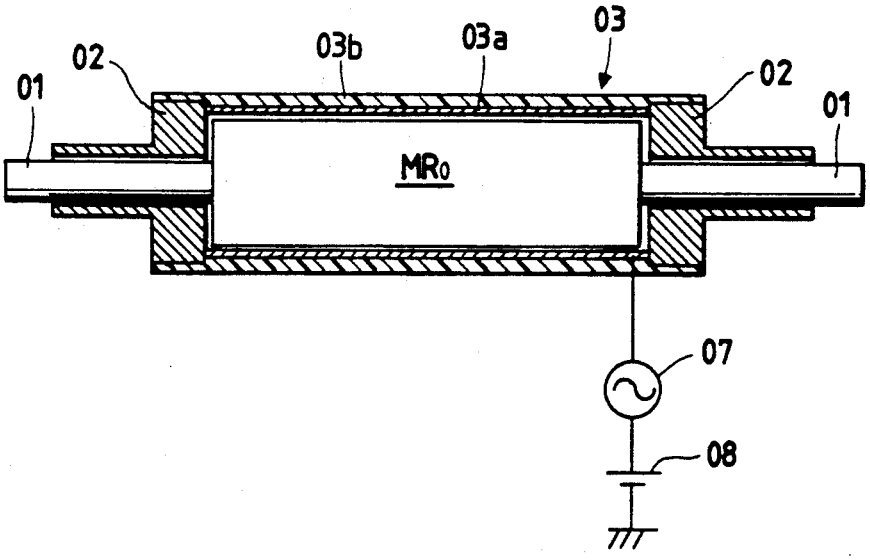
FIG. 4 PRIOR ART
Figure 5:
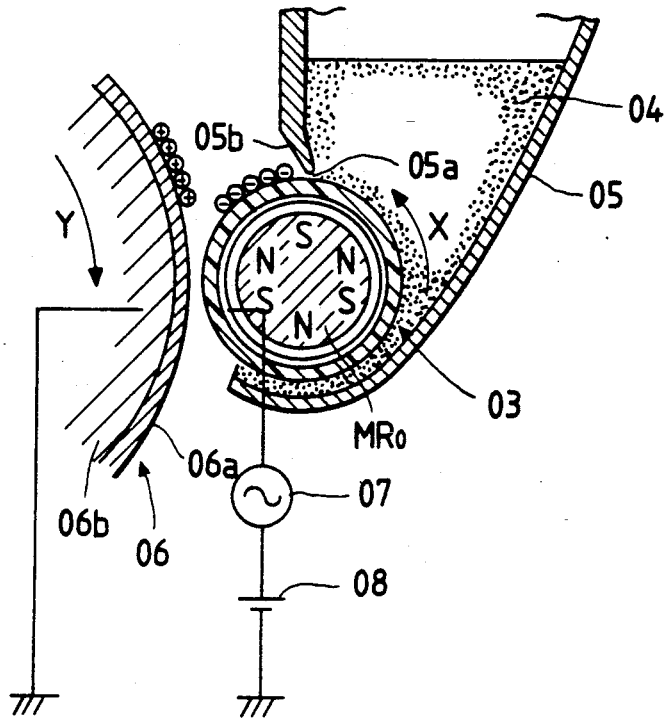
FIG. 5 PRIOR ART
Figure 8:
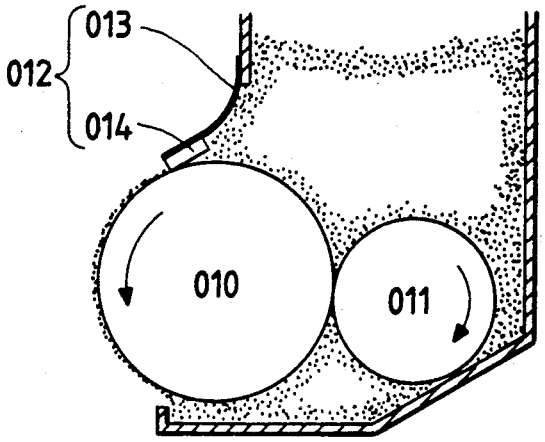
FIG. 8 is a diagram illustrating a conventional developing device using a single-component nonmagnetic toner.
Figure 6A:
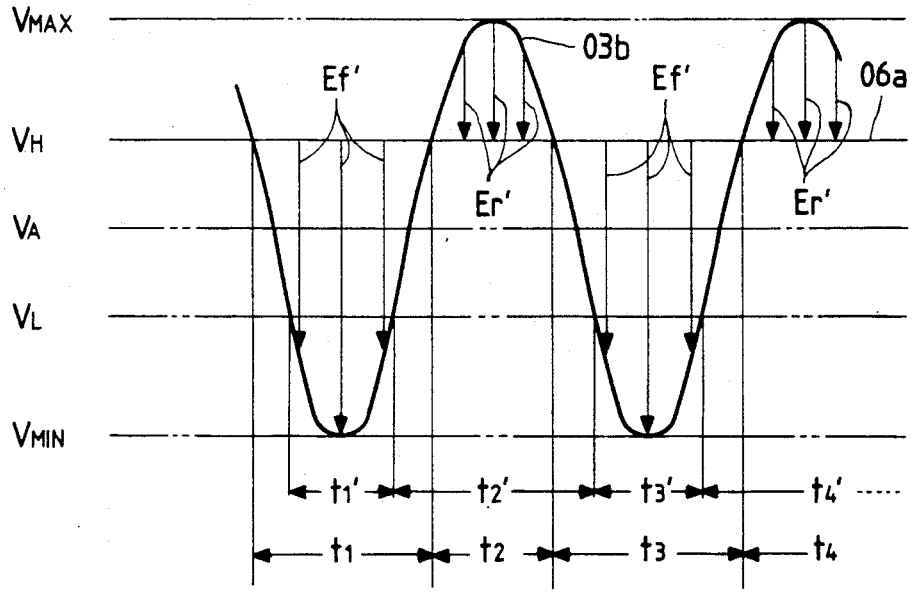
FIG. 6A PRIOR ART
Figure 6B:
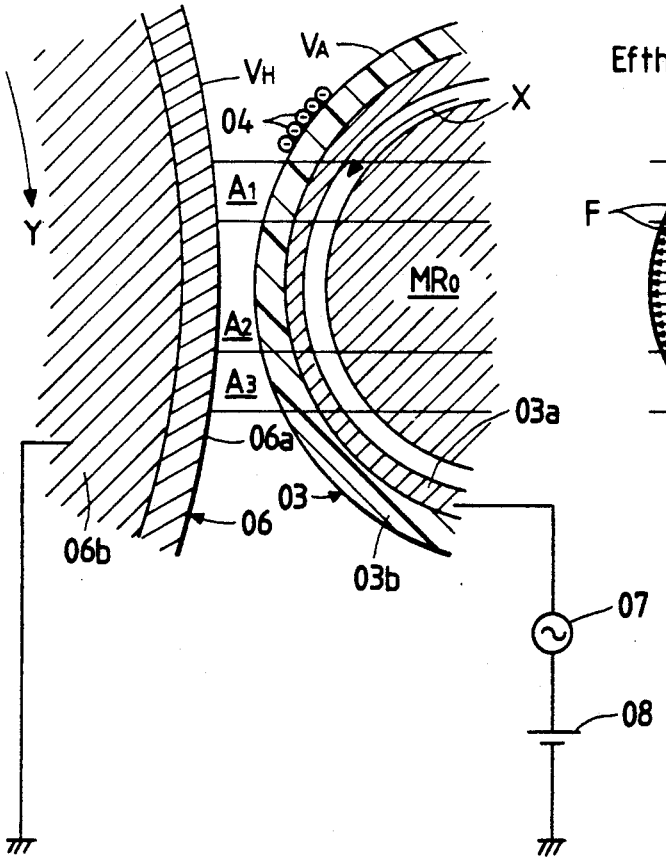
FIG. 6B PRIOR ART
Figure 6C:
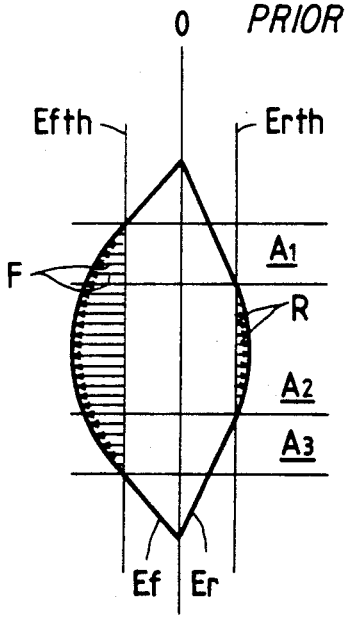
FIG. 6C PRIOR ART
Figure 7A:
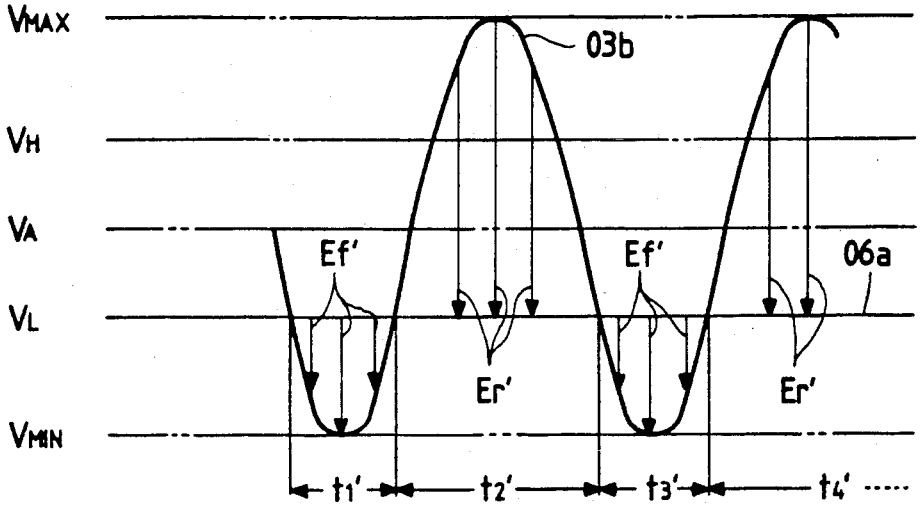
FIG. 7A PRIOR ART
Figure 7B:
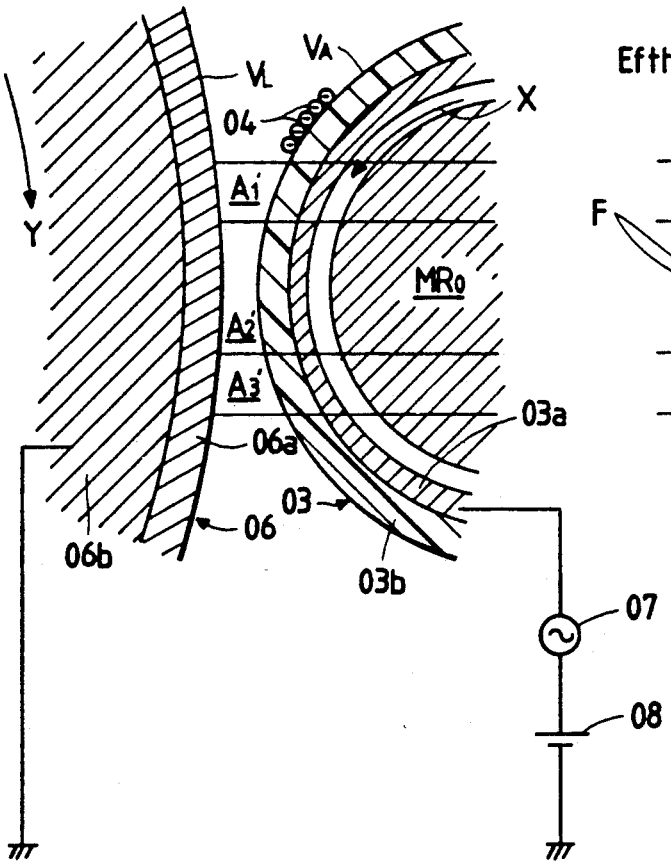
FIG. 7B PRIOR ART
Figure 7C:
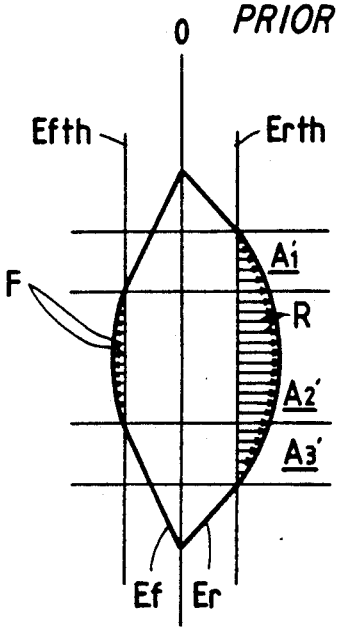
FIG. 7C PRIOR ART

As shown in FIGS. 2A, 3A, 3B, the thickness regulating member 18 includes a blade body 19 and a silicone rubber block 20 affixed at a free end portion of the blade body 19. The blade body 19 is made of, e.g., a thin, resilient stainless steel strip whose base portion is supported by the housing 10. The silicone rubber block 20 of the thickness regulating member 18 is nipped with the toner carrying body 3 surface substantially in the middle. Since the thickness regulating member 18 is buried into the single-component nonmagnetic toner, it is receiving a force biasing the toner carrying body 3 surface from the single-component nonmagnetic toner particles present in its back (the surface of the thickness regulating member 18 which is opposite to its surface confronting with the toner carrying body 3). With this biasing force, the thickness regulating member 18 can be nipped with the toner carrying body 3 properly even if the blade body 19 of the thickness regulating member 18 is made of a thin stainless steel strip which has an extremely small resiliency, In this embodiment, the silicone rubber block 20 of the thickness regulating member 18 is nipped with the toner carrying body 3 surface at a pressure as low as possible. Between the toner carrying body 3 surface and the ends of the silicone rubber block 20 exist wedge-like gaps 21. And these wedge-like gaps 21, by being set to proper values, serve to adjust the amount of the single-component nonmagnetic toner which is fed to the nipped portion between the toner carrying body 3 and the thickness regulating member 18.

As shown in FIGS. 2A, 2C, belt-like flexible brushes 22, 22 are disposed on the outer peripheral portions at both ends of the toner carrying body 3 in such a manner that they are interposed between the toner carrying body 3 and the housing 10. These brushes 22, 22 serve to prevent toner particles from falling out by stopping the toner particles from getting beyond the border of the toner Carrying body 3 in the axial direction.

An operation of the developing device having the toner carrying body 3 of the invention assembled thereto will be described next.

The single-component nonmagnetic toner supplied from the toner storage chamber 11 is stirred by the stirring stick 16 in the stirring chamber 12 and then fed into the toner carrying body accommodating chamber 14 while passing over the dam 13. The single-component nonmagnetic toner thus fed to the toner carrying body accommodating chamber 14 is then supplied from the wedge-like gaps 21 to the nipped portion where the surface of the toner carrying body 3 is nipped (in pressure contact) with the thickness regulating member 18 as the toner carrying body 3 rotates. The single-component nonmagnetic toner fed to the nipped portion is not only charged by friction thereat and adsorbed onto the toner carrying body 3 surface by the electrostatic force or the like, but also levelled by the thickness regulating member 18 that is nipped with the toner carrying body 3 surface so that the toner is formed into an even layer. At this instance, the toner particles will not be lumped at these gaps since the thickness regulating member 18 and the toner carrying body 3 surface are nipped with each other at a lowest possible pressure as described before. Also, any foreign matter (dust and the like) picked up in these gaps can be removed by granulated silica ($SiO_2O_3$) which is used to form irregularities with a surface roughness Rz of from about 2.5 to 4.5 ($\mu$m). As a result, the toner carrying body 3 surface is kept ready to form a stable and even toner layer thereon at all times.

Accordingly, the single-component nonmagnetic toner particles which have adhered to the toner carrying body 3 surface evenly are adsorbed onto an image forming portion on the photosensitive body surface 17 while fed at the portion where the toner carrying body 3 is nipped with the photosensitive body surface 17.

In the above developing device having the toner carrying body of the invention assembled thereto, the thickness regulating member 18 is so arranged as to be biased by the toner carrying body 3 while receiving the pressure of the toner at its back. Thus, the blade body 19 can be made of a material which is less resilient, and this allows the contact pressure between the semiconductive resin layer 5 of the toner carrying body 3 and the thickness regulating member 18 to be set to a small value, contributing to reducing the wear of both the thickness regulating member 18 and the semiconductive resin layer 5. Therefore, the thickness regulating member 18 and the toner carrying body 3 may have longer lives. Further, because the thickness of the semiconductive outer layer 5 on the surface of the toner carrying body 3 is set to 110 $\mu$m or more, there is no likelihood that the electrically conductive cylindrical sleeve will be exposed to the toner carrying body 3 even if the toner carrying body 3 surface (i.e., the semiconductive outer layer 5) has been worn or damaged to some degree. This allows a stable and even toner layer to be formed at all times and prevents discharge from occurring between the surfaces of the toner carrying body and the photosensitive body. A sample piece fabricated by the inventors, whose semiconductive outer layer 5 has a thickness of 60 $\mu$m, exhibited the same effect as that with the layer 5 of 110 $\mu$m in thickness, and this fact leads the inventors to assume that the thickness of the semiconductive outer layer 5 being 60 μm or more will cause no wear or damage problem.

While the developing device having the toner carrying body and the toner carrying body fabrication method, which are embodiments of the invention have been described in detail, the application of the invention is not limited to the above embodiments. Various design modifications may be made as long as they do not deviate from the scope of the invention defined in the appended claims.

For example, the semiconductive resin layer 5 which is formed on the surface of the cylindrical sleeve 4 may also be made of a coating material having the components shown in the following table.

| | |
|---|---|
| Electrically conductive carbon black | 3.5 wt % |
| Fine particles (siliceous extender pigment) | 16.0 wt % |
| Polyester resin | 21.7 wt % |
| Melamine resin | 7.2 wt % |
| Epoxy resin | 7.0 wt % |
| Xylol (aromatic hydrocarbon containing solvent) | 15.0 wt % |
| MIBK (ketone containing solvent) | 17.0 wt % |
| Butanol (alcoholic solvent) | 5.0 wt % |
| Butyl Cellosolve | 3.2 wt % |
| Additive (oil for dispersing the pigment) | 0.1 wt % |

The coating material may be composed at various other percentages by weight than the exemplified. Components other than the above may also be used. Further, the toner carrying body 3 may be applied to various other developing devices in which toner particles are not moved. In some developing devices, it may be only the dc bias power supply that is connected to the electrically conductive inner layer 4 to control the surface potential of the semiconductive outer layer 5. Still further, if a siliceous extender pigment is to be blended into a coating material for the semiconductive resin layer in order to form uniform irregularities on the surface of the toner carrying body, then the crystal silica whose maximum diameter is 1.0 μm or more, instead of about 2.5 μm, may be selected. The surface roughness Rz of the toner carrying body is not limited to from about 2.5 to 4.5 (μm), but may be any value as long as Rz ranges from about 1.0 to 10.0 (μm) or more to obtain a satisfactory effect. The toner carrying body of the invention may be applied to developing devices using toners other than the single-component nonmagnetic toner.

When a toner except the single-component nonmagnetic toner is used, if the thickness regulating member is arranged not to contact with the toner carrying body, the toner is triboelectrified by moving through the gap between the thickness regulating member and the toner carrying body, thereby forming the uniform toner layer on the toner carrying body.

The toner carrying body used in the developing device of the invention includes an electrically conductive metallic cylindrical sleeve and a semiconductive outer layer formed around the outer peripheral surface of the cylindrical sleeve. As a result, its construction is simple and it can be fabricated easily. The produced semiconductive outer layer has a smooth surface and exhibits only a small variation in resistivity by volume. Having the uniform irregularities on the outer surface, the toner carrying body of the invention can eliminate, with the projecting portions of its irregularities, any foreign matter trapped in the gaps formed between the toner carrying body and the thickness regulating member that is nipped with the toner carrying body. Therefore, the toner carrying body surface is ready to form a stable and even toner layer at all times. Since the irregularities formed on the toner carrying body surface serves to increase the toner adhering property, the toner carrying body of the invention may be applicable to developing devices which use single-component nonmagnetic toners whose adhesiveness to the toner carrying body surface is small. Since the toner carrying body of the invention uses an cylindrically formed electrically conductive metallic sleeve whose rigidity is larger than that of the conventional cylindrical sleeve made of a resin material, its thickness can be reduced without increasing its flexibility. Therefore, if the toner carrying body of the invention is applied to a developing device using a single-component magnetic toner, then the distance between the toner carrying body surface and a magnet roll disposed inside the cylindrical sleeve can be reduced, thereby allowing the magnetic force of the toner carrying body surface to be increased even with the magnetic force of the magnet roll being small.

The toner carrying body fabrication method of the invention allows the toner carrying body to be fabricated easily. Since the toner carrying body fabricated by such method has the fine particles that is used to form the uniform irregularities on its surface present in the interior of the semiconductive outer layer, the irregularities outlives the semiconductive outer layer even if the semiconductive outer layer is worn. In other words, the semiconductive outer layer will not lose the uniform irregularities formed on its surface even if worn.

What is claimed is:

1. A developing device having a cylindrical toner carrying body, said cylindrical toner carrying body including a cylindrical electrically conductive inner layer and an outer resin layer, and a surface potential at said outer resin layer being controlled by power supplies connected to said electrically conductive inner layer, so that particles of a single-component toner charged by friction can adhere to the surface of said outer resin layer, wherein said electrically conductive inner layer is a cylindrical sleeve of an electrically conductive metallic material, and said outer resin layer is a semiconductive resin layer coated on the outer peripheral surface of said cylindrical sleeve and has uniform irregularities defined predominately by non-conductive particles on the surface thereof to provide a surface roughness in the range of from 2.5 μm to 7.0 μm.

2. A developing device according to claim 1, wherein the surface roughness of said outer resin layer is in the range of from 2.5 μm to 4.5 μm.

3. A developing device according to claim 1, wherein said non-conductive particles are of a siliceous extender pigment.

4. A method of fabricating a cylindrical toner carrying body, said cylindrical toner carrying body including an electrically conductive inner layer and an outer resin layer, said electrically conductive inner layer being formed of a cylindrical sleeve made of an electrically conductive metallic material and said outer resin layer being made of a semiconductive resin layer formed on the outer peripheral surface of said cylindrical sleeve, a surface potential at said semiconductive outer layer being controlled by power supplies connected to said electrically conductive inner layer, so that particles of a single-component toner charged by friction can adhere to the surface of said semiconductive outer layer, wherein said method comprises the steps of:

applying a coating material to an outer peripheral surface of said cylindrical sleeve being made of an electrically conductive metallic material, said coating material being prepared by dispersing fine non-conductive particles into a solvent, said solvent being of such a type as to be cured at a predetermined condition to cause said fine particles to form uniform surface irregularities on said coating when cured; and curing said coating material thereafter, thereby to form a semiconductive resin layer over said outer peripheral surface of said cylindrical sleeve, the resin layer having a surface roughness defined predominately by the non-conductive particles and in the range of from 2.5 to 7.0 μm.

* * * * *

UNITED STATES PATENT AND TRADEMARK OFFICE

CERTIFICATE OF CORRECTION

PATENT NO. : 5,177,322

DATED : January 05, 1993

INVENTOR(S) : Masayuki Nishimura et al.

It is certified that error appears in the above-identified patent and that said Letters Patent is hereby corrected as shown below:

Claim 4, Column 15, Line 8, Delete "as".

Signed and Sealed this

Twenty-eighth Day of December, 1993

*Attest:*

Bruce Lehman

BRUCE LEHMAN

*Attesting Officer*

*Commissioner of Patents and Trademarks*